US010711551B2

(12) United States Patent
Al-Ramadhan

(10) Patent No.: US 10,711,551 B2
(45) Date of Patent: Jul. 14, 2020

(54) MILLING DOWNHOLE TUBULARS

(71) Applicant: Saudi Arabian Oil Company, Dhahran (SA)

(72) Inventor: Ahmed A. Al-Ramadhan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 89 days.

(21) Appl. No.: 16/045,123

(22) Filed: Jul. 25, 2018

(65) Prior Publication Data

US 2020/0032604 A1 Jan. 30, 2020

(51) Int. Cl.

| | |
|---|---|
| ***E21B 29/00*** | (2006.01) |
| ***E21B 31/16*** | (2006.01) |
| ***E21B 31/20*** | (2006.01) |
| ***E21B 31/00*** | (2006.01) |
| ***E21B 37/00*** | (2006.01) |

(52) U.S. Cl.

CPC ..... *E21B 29/005* (2013.01); *E21B 31/16* (2013.01)

(58) Field of Classification Search

CPC ..... E21B 29/005; E21B 31/16; E21B 31/20; E21B 27/00; E21B 29/00; E21B 31/18; E21B 31/08; E21B 37/00; E21B 29/002; E21B 31/00

See application file for complete search history.

(56) References Cited

U.S. PATENT DOCUMENTS

| | | | |
|---|---|---|---|
| 3,147,536 | A | 9/1964 | Lamphere |
| 4,059,155 | A | 11/1977 | Greer |
| 4,254,983 | A | 3/1981 | Harris |
| 4,276,931 | A | 7/1981 | Murray |
| 4,696,502 | A | 9/1987 | Desai |
| 5,012,863 | A | 5/1991 | Springer |
| 5,176,208 | A | 1/1993 | Lalande et al. |

(Continued)

FOREIGN PATENT DOCUMENTS

WO WO 2010132807 11/2010

OTHER PUBLICATIONS

PCT International Search Report and Written Opinion in International Appln. No. PCT/US2019/042946, dated Sep. 11, 2019, 13 pages.

(Continued)

*Primary Examiner* — Giovanna Wright
*Assistant Examiner* — Manuel C Portocarrero
(74) *Attorney, Agent, or Firm* — Fish & Richardson P.C.

(57) ABSTRACT

A central shaft defines a first interior flow path. The central shaft disposed at least partially within a washover pipe. A lead tapered mill is positioned at a downhole end of the central shaft to center the downhole-type milling tool within a tubular. The lead tapered mill defines a second central flow path in line with the first interior flow path. Milling blades extend between the central shaft and the washover pipe. The milling blades are arranged to allow fluid flow around the milling blades. Each of the milling blades includes a tungsten-carbide hardened face and a soft steel body configured to support a load of the downhole-type milling tool during milling operations. A junk basket is positioned within the washover pipe uphole of the milling blades to receive and retain cuttings formed by the milling blades.

19 Claims, 6 Drawing Sheets

(56) References Cited

U.S. PATENT DOCUMENTS

| | | | | |
|---|---|---|---|---|
| 5,944,101 | A | 8/1999 | Hearn | |
| 6,276,452 | B1 | 8/2001 | Davis et al. | |
| 7,096,950 | B2 | 8/2006 | Howlett et al. | |
| 7,188,674 | B2 | 3/2007 | McGavern, III et al. | |
| 7,497,260 | B2 | 3/2009 | Telfer | |
| 8,453,724 | B2 | 6/2013 | Zhou | |
| 9,574,417 | B2 | 2/2017 | Laird et al. | |
| 2001/0035302 | A1* | 11/2001 | Desai | E21B 10/54 175/61 |
| 2012/0118571 | A1 | 5/2012 | Zhou | |

OTHER PUBLICATIONS

Scribd [online], "Milling Practices and Procedures," retrieved from URL <https://www.scribd.com/document/358420338/Milling-Rev-2-Secured>, 80 pages.

* cited by examiner

MILLING DOWNHOLE TUBULARS

TECHNICAL FIELD

This disclosure relates to downhole milling tools.

BACKGROUND

In hydrocarbon production, wellbores are formed to produce hydrocarbons. Drilling, operating, and maintaining wellbores includes placing tubular members within the wellbore. For example, casing can line the wellbore in certain configurations. In some instances, production tubing is also used in lieu of or in addition to the casing. During the drilling process, a drill string made up of metal piping is also extended into the wellbore. In some instances, a metal tubular needs to be removed from a wellbore. For example, in situations where a drill pipe gets stuck or production tubing needs to be replaced. In such situations, the tubular can be milled, ground away, or both. Such a process involves breaking, cutting, grinding, or shaving the tubular into small pieces to ease removal.

SUMMARY

This disclosure describes technologies relating to milling downhole tubulars.

An example implementation of the subject matter described within this disclosure is a downhole-type milling tool with the following features. A central shaft defines a first interior flow path. The central shaft disposed at least partially within a washover pipe. A lead tapered mill is positioned at a downhole end of the central shaft to center the downhole-type milling tool within a tubular. The lead tapered mill defines a second central flow path in line with the first interior flow path. Milling blades extend between the central shaft and the washover pipe. The milling blades are arranged to allow fluid flow around the milling blades. Each of the milling blades includes a tungsten-carbide hardened face and a soft steel body configured to support a load of the downhole-type milling tool during milling operations. A junk basket is positioned within the washover pipe uphole of the milling blades to receive and retain cuttings formed by the milling blades.

Aspects of the example implementation, which can be combined with the example implementation alone or in combination, include the following. The junk basket includes spring-loaded fingers extending from an inner surface of a washover pipe to retain milled tubular pieces from moving in a downhole direction. The spring-loaded fingers are hingably attached to the inner surface of the washover pipe. A central support shoulder mounted to the central shaft is positioned to limit a downhole motion of the spring-loaded fingers. A screen positioned uphole of the plurality of spring-loaded fingers allows fluid passage and prevents particles greater than a specified size from passing through the screen.

Aspects of the example implementation, which can be combined with the example implementation alone or in combination, include the following. The milling blades are arranged in layers longitudinally around the shaft.

Aspects of the example implementation, which can be combined with the example implementation alone or in combination, include the following. Each layer includes three milling blades.

Aspects of the example implementation, which can be combined with the example implementation alone or in combination, include the following. The layers include a first layer and a second layer positioned uphole of the first layer.

Aspects of the example implementation, which can be combined with the example implementation alone or in combination, include the following. The layers include eight layers.

An example implementation of the subject matter described within this disclosure is a method with the following features. A downhole-type milling tool is centered onto a downhole tubular with a tapered mill positioned on a downhole end of the downhole-type milling tool. The downhole tubular located in a wellbore is milled with a downhole-type milling tool. Pieces of the milled tubular are received with a junk basket positioned uphole of a set of milling blades within the downhole-type milling tool. The pieces are retained within the downhole-type milling tool.

Aspects of the example implementation, which can be combined with the example implementation alone or in combination, include the following. A flowing fluid is received through a central flow path within the downhole-type milling tool. Pieces of the milled tubular are transferred to the junk basket by the flowing fluid.

Aspects of the example implementation, which can be combined with the example implementation alone or in combination, include the following. A first set of milling blades is eroded. The tubular continues to be milled with a second set of milling blades uphole the first set of the milling blades.

Aspects of the example implementation, which can be combined with the example implementation alone or in combination, include the following. A wellbore casing is protected from the set of milling blades with a washover pipe located on an outer radius of the downhole-type milling tool.

Aspects of the example implementation, which can be combined with the example implementation alone or in combination, include the following. The downhole tubular is retained within the downhole-type milling tool with a washover pipe located on an outer radius of the downhole-type milling tool.

An example implementation of the subject matter described within this disclosure is a downhole-type milling tool with the following features. A central shaft defines a first interior flow path. The central shaft is disposed at least partially within a washover pipe. Milling blades extending between the central shaft and the washover pipe. A junk basket positioned within the washover pipe uphole of the plurality of milling blades receives and retains cuttings formed by the milling blades.

Aspects of the example implementation, which can be combined with the example implementation alone or in combination, include the following. A lead tapered mill is positioned at a downhole end of the central shaft. The lead tapered mill defines a second central flow path in line with the first interior flow path.

Aspects of the example implementation, which can be combined with the example implementation alone or in combination, include the following. The milling blades are arranged in a layers longitudinally around the shaft.

Aspects of the example implementation, which can be combined with the example implementation alone or in combination, include the following. Each layer includes three milling blades.

Aspects of the example implementation, which can be combined with the example implementation alone or in combination, include the following.

combination, include the following. The layers include a first layer and a second layer positioned uphole of the first layer.

Aspects of the example implementation, which can be combined with the example implementation alone or in combination, include the following. The layers include eight layers.

Aspects of the example implementation, which can be combined with the example implementation alone or in combination, include the following. The milling blades are between 40-50% of the area between the washover pipe and the central shaft at a transverse cross-section taken at one of the layers.

Aspects of the example implementation, which can be combined with the example implementation alone or in combination, include the following. Each of the milling blades includes a steel body and a tungsten-carbide hardened face positioned on a downhole side of the steel body.

Aspects of the example implementation, which can be combined with the example implementation alone or in combination, include the following. The junk basket includes spring-loaded fingers extending from an inner surface of the washover pipe. The spring-loaded fingers are hingably attached to the inner surface of the washover pipe. A central support shoulder mounted to the central shaft is positioned to limit a downhole motion of the spring-loaded fingers. A screen uphole of the spring-loaded fingers allows fluid passage and prevents particles greater than a specified size from passing through the screen.

Aspects of the example implementation, which can be combined with the example implementation alone or in combination, include the following. the junk basket is a first junk basket, the tool further includes a second junk basket uphole of the first junk basket.

Particular implementations of the subject matter described in this disclosure can be implemented so as to realize one or more of the following advantages. Aspects of this disclosure can help prevent or reduce frequency risk of accidental side tracking during milling operations. With multiple layers of milling blades, the tool can be used for a longer period of time. The integrated junk basket reduces the length of the tool and enhances junk recovery. These factors can result in fewer trips during milling operations and improve milling and hole-cleaning efficiency.

The details of one or more implementations of the subject matter described in this disclosure are set forth in the accompanying drawings and description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to milling and tools that allow extensive and continuous milling operation on tubulars (such as, tubing, drill pipe, or casing), that cannot be normally recovered by fishing operations. The tools operate in an efficient manner without having to trip out to change the mill and without leaving excessive junk in the well. The tools can reduce the chance of accidentally sidetracking the well. That is, the tool is unlikely to veer off-course and drill into the sidewall of the wellbore rather than milling the tubular. The tools include a washover pipe that surrounds a central shaft. Multiple layers of milling blades extend between the central shaft and the washover pipe. As one layer of blades becomes worn, a new layer of blades comes in contact with the target tubular. Such a tool reduces the need for multiple trips due to work blades. The washover pipe retains and centralizes the pipe over the target tubular, reducing the likelihood of accidental sidetracking. The tools incorporate a junk basket positioned to receive and retain milled pieces of the target tubular. The milled tubular pieces can be too heavy to be circulated all the way to a topside facility. In such instances, the tool collects the milled pieces and prevents them from collecting downhole and plugging the wellbore. The junk basket is positioned uphole of the milling blades.

Figure 1:
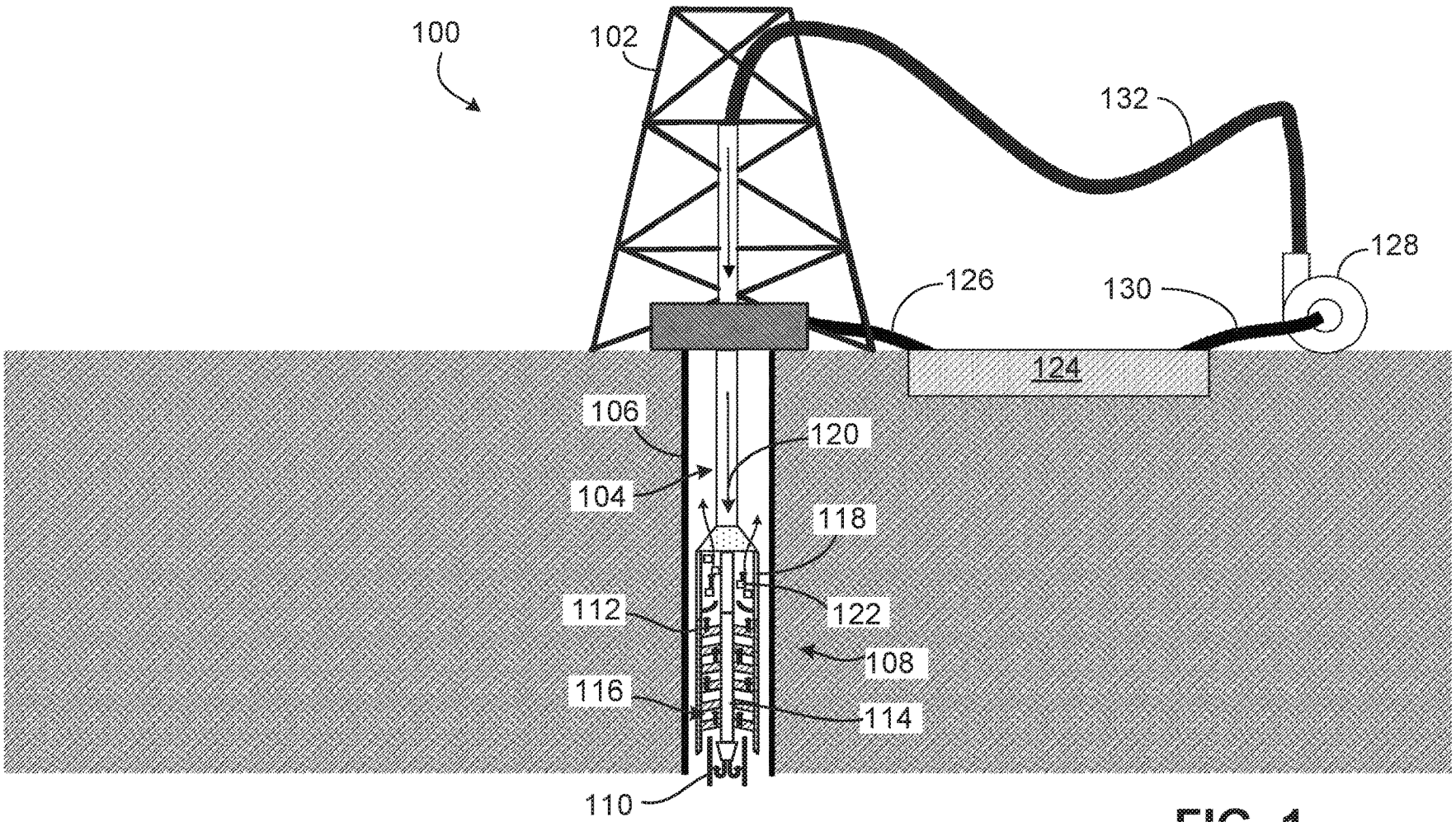
FIG. 1 is a schematic view of a wellsite.

FIG. 1 is a schematic view of a wellsite 100. The wellsite 100 includes a derrick 102 that supports a tool string 104 within a wellbore 106. The downhole end of the tool string 104 has a downhole-type milling tool 108 configured to mill a tubular 110 within the wellbore 106. The downhole-type milling tool 108 includes a washover pipe 112, a central shaft 114, milling blades 116 that extend between the central shaft 114 and the washover pipe 112, and a junk basket 118 positioned within the washover pipe 112 uphole of the milling blades 116. The washover pipe 112 extends around the milling blades 116 and the junk basket 118. The washover pipe 112 is attached to a radial surface of the milling blades 116. The washover pipe 112 can protect, for example, a casing, a wellbore wall, or both, from the milling blades 116. The junk basket 118 is configured to receive and retain cuttings of the tubular 110 formed by the milling blades 116.

During milling operations, the downhole-type milling tool 108 is lowered onto a target tubular 110 and rotated. The downhole-type milling tool 108 scrapes or grinds the target tubular 110 into smaller pieces called cuttings. A circulation fluid 120 is pumped through the tool string 104 and out the downhole end of the downhole-type milling tool 108. The circulation fluid 120 then flows up through the downhole-type milling tool 108 carrying cuttings of the tubular 110 in an uphole direction within the downhole-type milling tool 108. The tool retains the cuttings 122 of the tubular greater than a specified size threshold. The cuttings 122 can vary from very fine shavings (0.1 to 0.5 inch length) to larger chunks of torn tubulars (5 to 12 inch length). Larger junk that cannot go through the openings between the milling blades can be further grinded by the mills until the cuttings 122 are able to pass. The circulation fluid then flows through an annulus of the wellbore 106 in an uphole direction. The circulation fluid is directed to a fluid pit 124 by a first conduit 126. The fluid pit 124 retains the circulation fluid 120 for a sufficient amount of time as to allow particles to settle out of the fluid. The circulation fluid then flows into a circulation pump 128 through a second conduit 130. The circulation pump 128 pumps the fluid back through the tool string 104 by a third conduit 132. The conduits can include hose, pipe, open channels, filters, or any combination capable of handling the desired pressures and flowrates. In some implementations, a weight of the circulation fluid can be adjusted during milling operations. Similarly, a weight on the milling tool can be adjusted during operations. The weight on the milling tool is controlled by an operator at surface by slacking off more string weight. The weight on the downhole-type milling tool 108 can have impact on the milling rate. Usually the drilled controls the weight on downhole-type milling tool 108, rotations per minute (RPM), and circulation rate to find the optimum parameters to achieve best rate of milling. Optimal parameters can vary between well sites and individual circumstances. While the illustrated system 100 is shown in the context of a vertical wellbore, the downhole-type milling tool 108 can also be used in deviated or horizontal wellbores.

Figure 2:
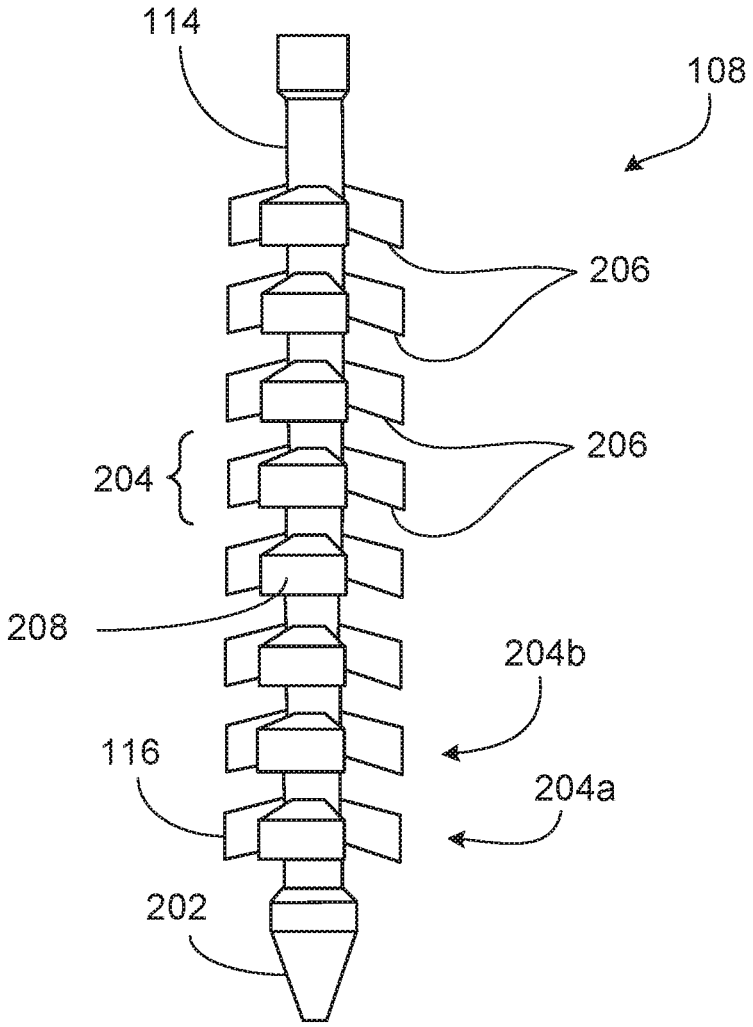
FIG. 2 is a side perspective view of a downhole-type milling tool with the washover pipe removed.

FIG. 2 is a side perspective view of a portion of the wellbore milling tool 108 with the washover pipe 112 (see FIG. 1) removed for easier viewing of internal components. The downhole-type milling tool 108 includes a central shaft 114 that defines a first interior flow path through which circulation fluid 120 (see FIG. 1) is pumped during operation. The central shaft 114 is at least partially disposed within the washover pipe 112 (see FIG. 1). A lead tapered mill 202 is positioned at a downhole end of the central shaft 114. The lead tapered mill 202 defines a second central flow path that is in line with the first central flow path. The lead tapered mill 202 is configured to help center the downhole-type milling tool within the tubular 110 (see FIG. 1). The lead tapered mill 202 has a distal end with a smaller cross-sectional area than the end attached to the central shaft 114. The reduced cross-section at the distal end allows easier entry into the target tubular 110. Multiple milling blades 116 radiate from the central shaft 114 with the milling blades 116 extending between the central shaft 114 and the washover pipe 112 (not shown). The milling blades 116 are arranged to allow fluid to flow around the milling blades 116. For example, the milling blades are between are arranged to block 40-50% of the area between the washover pipe and the central shaft of a transverse cross-section taken at one of the layers 204 of milling blades 116. The milling blades 116 are configured to mill the downhole tubular 110 (see FIG. 1). Each of the milling blades 116 includes a tungsten-carbide hardened face 206 on a soft steel body 208. The tungsten-carbide hardened face 206 contacts the target tubular 110 and scrapes cuttings off the target tubular. The soft steel body 208 has sufficient strength to support a load of the downhole-type milling tool 108 during milling operations. The downhole-type milling tool 108 is capable of supporting around ten thousand pounds of string weight on the downhole-type milling tool 108. The body of each blade is softer than the normal wellbore tubular material, such as K-55 or J-55, to wear easily while milling once the hard face is eroded. During operation, the soft steel body 208 erodes after the tungsten-carbide hardened face 206 is worn away. The specific geometry of each blade is situation dependent. Stress calculations and other engineering work is done to determine optimal geometries for each situation. In general, the thickness of each blade has to withstand the weight on downhole-type milling tool and the torque of milling operation, for example, ten thousand pounds bit-weight and eight thousand pound feet of torque.

As illustrated in FIG. 2, the milling blades 116 are arranged in layers 204 longitudinally around the shaft. In the downhole-type milling tool 108, each layer 204 includes three milling blades 116. As illustrated, there are eight layers 204. While the illustrated implementation is shown with eight layers of milling blades, each layer with three blades, other arrangements can be used depending on the specific requirements. For example, some downhole-type milling tools include more layers if a longer tubular is being milled or fewer layers if a shorter tubular is being milled. Greater or fewer blades can be used on each layer as well. For example, as little as two blades can be used per layer or as many as five blades can be used per layer. In general, fewer, larger blades in every layer improves the weight carrying capacity, but care should be taken to maintain the flow area between the blades for easier junk collection. The number of layers is situation dependent. For example, a longer tubular requires more layers. While the illustrated implementation shows each layer of blades being longitudinally aligned, blades of each layer can be offset from one another.

During operation, a first layer 204*a* at the downhole end of the downhole-type milling tool 108 contacts and mills the tubular 110 (FIG. 1). Once the hardened face 206 is worn away, the soft body 208 of each of the blades 116 in the first layer 204*a* erodes until the second layer 204*b* contacts the tubular. This process repeats for each subsequent layer.

Figure 3A:
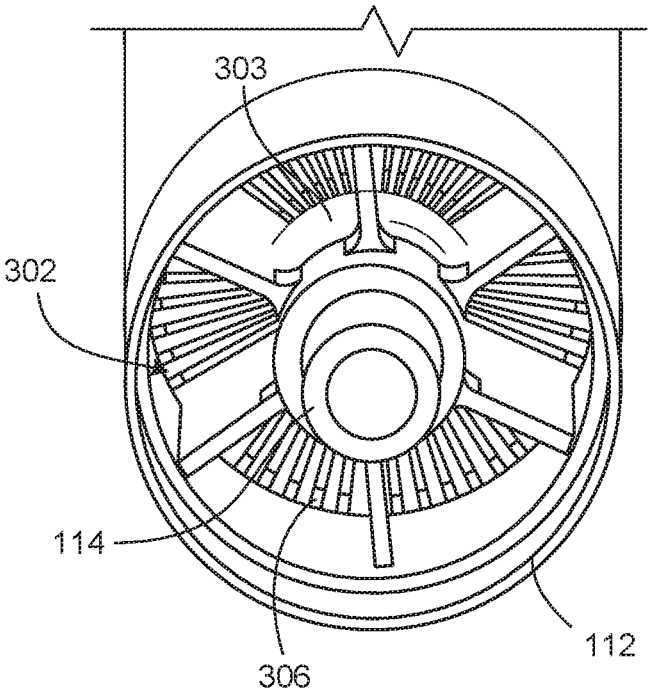
FIG. 3A is an upward perspective view of a portion of a junk basket.

FIG. 3A is an upward perspective view of a portion of the junk basket 118. The junk basket 118 includes spring-loaded fingers 302 that extend from an inner surface of the washover pipe 112. The spring-loaded fingers 302 are hinged from the inner surface of the washover pipe 112. The spring-loaded fingers 302 are configured to retain milled tubular pieces from moving in a downhole direction. That is, in operation, the spring-loaded fingers 302 pivot in an uphole direction when large milled tubular pieces flow in an uphole direction, but pivot in a downhole direction to rest upon a central support shoulder 304 in the event that the large pieces move in a downhole direction. The central support shoulder 304 is mounted to the central shaft 114 and is configured to limit the downhole motion of the spring-loaded fingers 302. That is, the fingers 302 are of sufficient length and the shoulder 304 is of sufficient girth to cause an interference and prevent further travel of the fingers 302 in the downhole direction. In some tools, the fingers 302 are not spring-loaded.

Figure 3B:
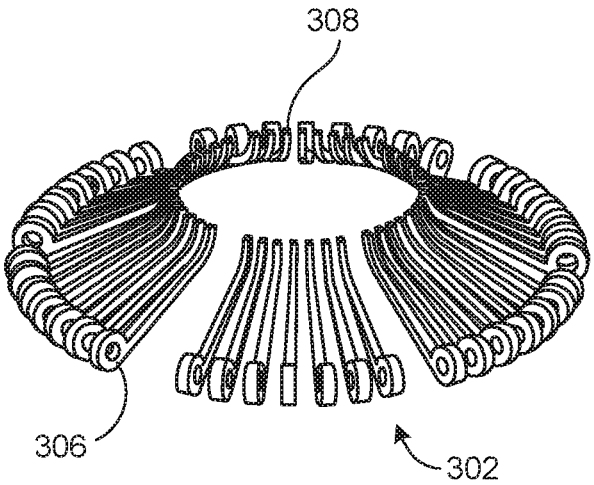
FIG. 3B is a side perspective view of the fingers of the junk basket shown in FIG. 3A.

FIG. 3B is a side perspective view of the fingers 302 of the junk basket 118 shown in FIG. 3A. As illustrated, the ends 306 of the fingers 302 closest to the washover pipe 112 are attached to the washover pipe 112 by hinges. The distal ends 308 of the fingers 302 have a slant in an uphole direction. The slant allows for easier passage of tubular cuttings past the fingers. In some implementations, the slant can help distribute the load of the resting fingers 302 from the shoulder 304 to the central shaft 114. In some implementations, the shoulder 304 is not needed and the fingers are of sufficient length for the shaft 114 to act as an interference. In some implementations, the distal ends 308 of the fingers 302 do not include a taper. The fingers can be made of metal, composite, elastomer, or other materials with sufficient strength and corrosion resistance for a wellbore environment.

Figure 3C:
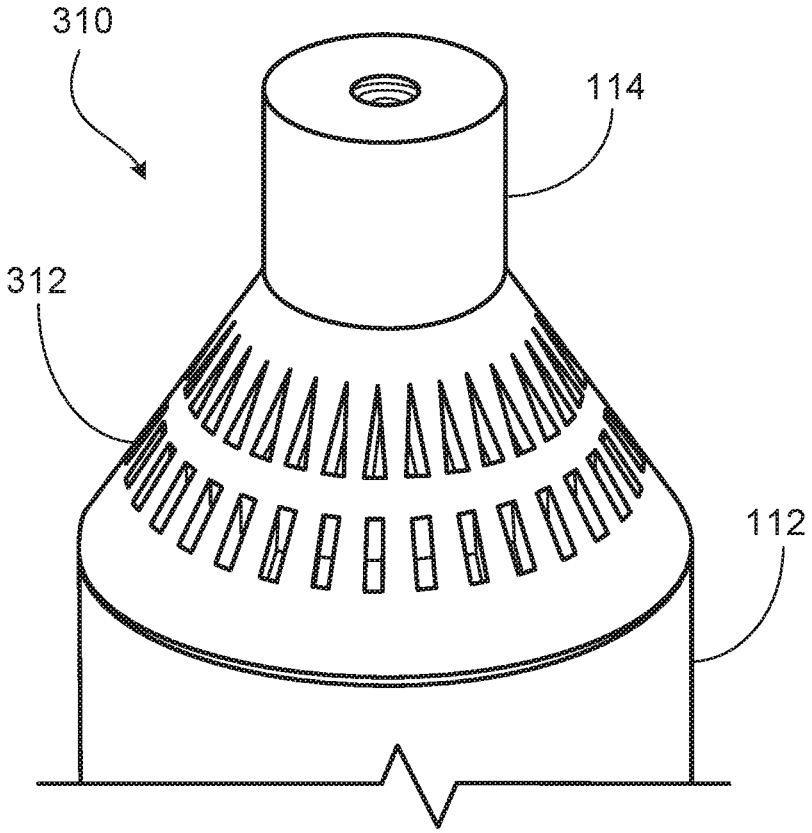
FIG. 3C is a side perspective view of an uphole end of the junk basket shown in FIG. 3A.

FIG. 3C is a side perspective view of an uphole end of the junk basket 118 shown in FIG. 3A. A screen 310 is positioned uphole of the spring-loaded fingers 302. The screen 310 includes holes 312 that allow fluid passage to pass through the screen 310, but prevent particles greater than a specified size, such as large milled pieces of the tubular 110 (see FIG. 1) from passing through the screen 310. While previously described and illustrated as having a single junk basket 118, the downhole-type milling tool 108 can include multiple junk baskets in series. For example, the downhole-type milling tool 108 can include a first junk basket uphole of the milling blades 116, and a second junk basket uphole of the first junk basket. In general, multiple junk basket increase junk recovering capacity.

Figure 4D:
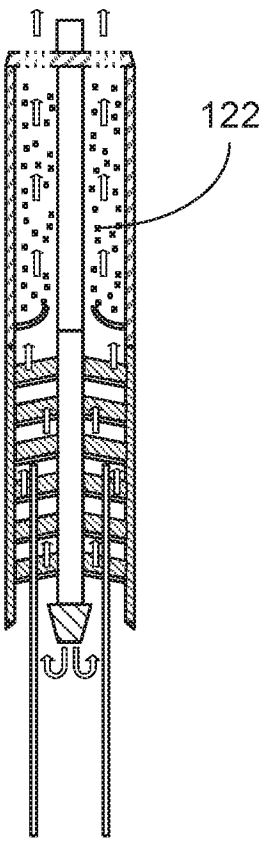
FIGS. 4A-4D are schematic side views of a downhole-type milling tool in various stages of operation.
Figure 4C:
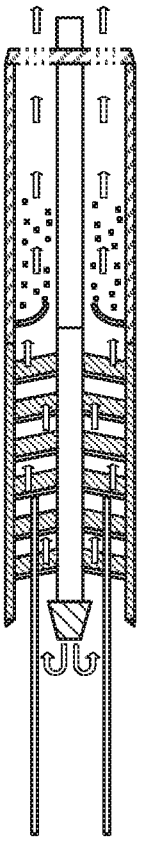
Figure 4B:
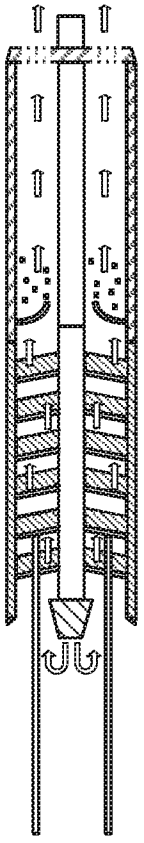
Figure 4A:
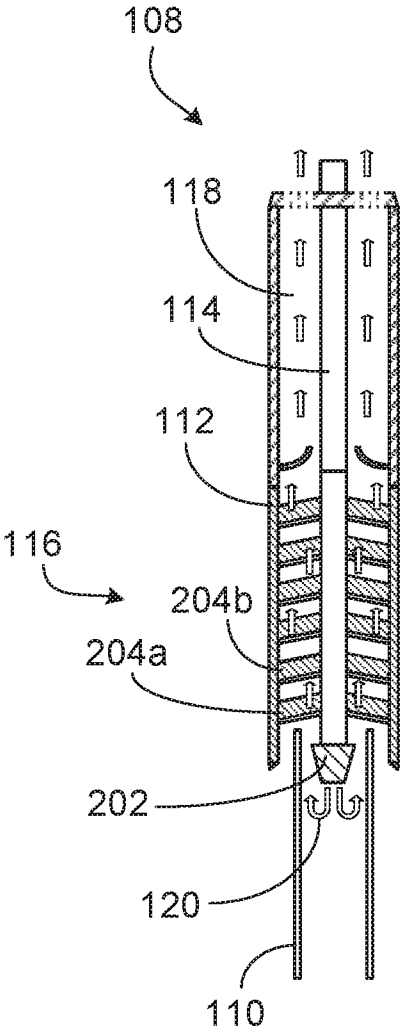

FIGS. 4A-4D show side cross-sectional views of an example downhole-type milling tool 108 in various stages of operation. In FIG. 4A, the downhole-type milling tool 108 first comes in contact with the tubular 110. The tapered mill 202 helps initially center the downhole-type milling tool 108 on the tubular 110. The downhole-type milling tool 108 rotates and the first layer 204*a* of milling blades mill the tubular 110. The washover pipe 112 helps retain the downhole-type milling tool 108 on the tubular 110 and protects an outer casing, wellbore wall, or both from the milling blades 116.

In FIG. 4B, the first layer 204*a* of milling blades 116 has been worn through. As a result, the second layer 204*b* of milling blades 116 is in contact with the tubular 110. As circulation fluid 120 flows through the tool, cuttings 122 of the tubular 110 are suspended in the circulation fluid 120 and flow in an uphole direction. The cuttings 122 are received and retained within the junk basket 118. The screen 310 at the uphole end of the junk basket 118 retain large cuttings 122 of the tubular 110 within the junk basket 118. The fingers 302 limit the movement of the large cuttings 122 of the tubular 110 on a downhole side of the junk basket 118. FIGS. 4C-4D continue the process; as each layer 204 of milling blades 116 is worn, the next layer 204 of milling blades is used until all of the layers 204 of milling blades 116 are worn or until the tubular 110 has been sufficiently milled. Weight on the downhole-type milling tool 108 is controlled and monitored at the surface by a string weight indicator (not shown). The string weight is measured once prior to contacting the tubular, and once after contacting the top of object to be milled. The weight on the downhole-type milling tool 108 is the reduction in weight of string at surface. Whenever the milling layer is worn-out, the string will move down and hit the milled object with the second milling layer resulting in a shock in string and can be noticed on the weight indicator at surface. Such a shock occurs for every layer as it is worn.

Figure 5:
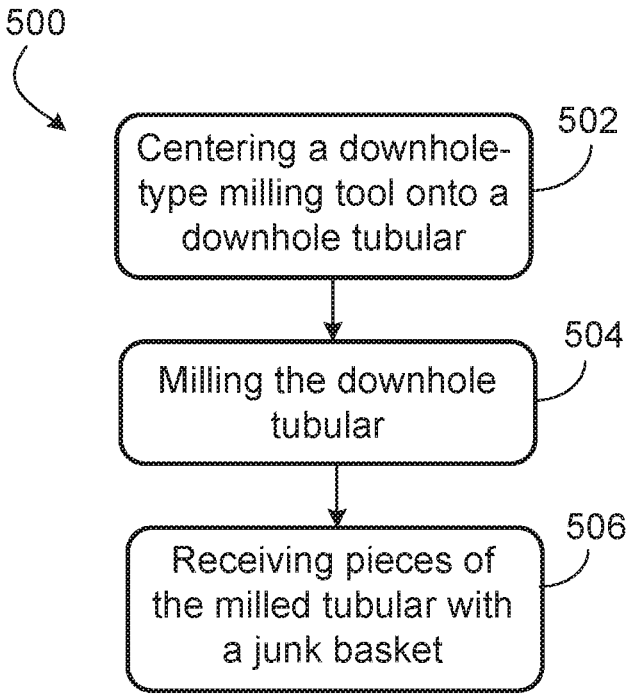
FIG. 5 is a flowchart of a method that can be used with aspects of this disclosure.

FIG. 5 is a flowchart of an example method 500 that can be used with aspects of this disclosure. At 502, a downhole-type milling tool is centered onto a downhole tubular with a tapered mill positioned on a downhole end of the downhole-type milling tool. The downhole tubular is retained within the downhole-type milling tool with a washover pipe located on an outer radius of the downhole-type milling tool. A wellbore casing is protected from the set of milling blades with the washover pipe. At 504, the downhole tubular located in a wellbore is milled with the downhole-type milling tool. A first set of milling blades is eroded. The tubular continues to be milled with a second set of milling blades uphole the first set of the milling blades. At 506, pieces of the milled tubular are received with a junk basket positioned uphole of a set of milling blades within the downhole-type milling tool. A flowing fluid is received through a central flow path within the downhole-type milling tool. The flowing fluid transfers pieces of the milled tubular to the junk basket.

The downhole-type milling tool 108 can be assembled in a variety of ways without departing from this disclosure. For example, smaller components of the downhole-type milling tool, such as the washover pipe or shaft blades, can either by welded together or fastened by threads or fasteners. Large parts, such as the milling assembly and the junk recovery tube, can be connected together by threading for easier mantling and dismantling at rig site.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A downhole-type milling tool comprising:

a washover pipe;

a central shaft that defines a first interior flow path, the central shaft disposed at least partially within the washover pipe;

a lead tapered mill positioned at a downhole end of the central shaft to center the downhole-type milling tool within a tubular, the lead tapered mill defining a second central flow path in line with the first interior flow path;

a plurality of milling blades extending between the central shaft and the washover pipe, the plurality of milling blades being arranged to allow fluid flow around the plurality of milling blades, wherein each of the plurality of milling blades comprises:

a tungsten-carbide hardened face; and a soft steel body configured to support a load of the downhole-type milling tool during milling operations; and a junk basket positioned within the washover pipe uphole of the plurality of milling blades to receive and retain cuttings formed by the milling blades, wherein the junk basket comprises:

a plurality of spring-loaded fingers extending from an inner surface of a washover pipe to retain milled tubular pieces from moving in a downhole direction, the plurality of spring-loaded fingers hingably attached to the inner surface of the washover pipe;

a central support shoulder mounted to the central shaft positioned to limit a downhole motion of the spring-loaded fingers; and a screen uphole of the plurality of spring-loaded fingers to allow fluid passage and to prevent particles greater than a specified size from passing through the screen.

2. The downhole-type milling tool of claim 1, wherein the milling blades are arranged in a plurality of layers longitudinally around the shaft.

3. The downhole-type milling tool of claim 2, wherein each layer comprises three milling blades.

4. The downhole-type milling tool of claim 2, wherein the layers comprise a first layer and a second layer positioned uphole of the first layer.

5. The downhole-type milling tool of claim 4, wherein the layers comprise eight layers.

6. A method comprising:

centering a downhole-type milling tool onto a downhole tubular with a tapered mill positioned on a downhole end of the downhole-type milling tool;

milling the downhole tubular located in a wellbore with a downhole-type milling tool; and receiving pieces of the milled tubular with a junk basket positioned uphole of a set of milling blades within the downhole-type milling tool, the pieces being retained within the downhole-type milling tool, wherein the junk basket comprises:

a plurality of spring-loaded fingers extending from an inner surface of a washover pipe to retain milled tubular pieces from moving in a downhole direction, the plurality of spring-loaded fingers hingably attached to the inner surface of the washover pipe;

a central support shoulder mounted to the central shaft positioned to limit a downhole motion of the spring-loaded fingers; and a screen uphole of the plurality of spring-loaded fingers to allow fluid passage and to prevent particles greater than a specified size from passing through the screen.

7. The method of claim 6, further comprising:

receiving a flowing fluid through a central flow path within the downhole-type milling tool; and transferring pieces of the milled tubular to the junk basket by the flowing fluid.

8. The method of claim 6, further comprising:

eroding a first set of milling blades; and continuing to mill the tubular with a second set of milling blades uphole the first set of the milling blades.

9. The method of claim 6, further comprising protecting a wellbore casing from the set of milling blades with a washover pipe located on an outer radius of the downhole-type milling tool.

10. The method of claim 6, further comprising retaining the downhole tubular within the downhole-type milling tool with a washover pipe located on an outer radius of the downhole-type milling tool.

11. A downhole-type milling tool comprising:

a washover pipe;

a central shaft that defines a first interior flow path, the central shaft disposed at least partially within the washover pipe;

a plurality of milling blades extending between the central shaft and the washover pipe; and a junk basket positioned within the washover pipe uphole of the plurality of milling blades to receive and retain cuttings formed by the milling blades, wherein the junk basket comprises:

a plurality of spring-loaded fingers extending from an inner surface of a washover pipe to retain milled tubular pieces from moving in a downhole direction, the plurality of spring-loaded fingers hingably attached to the inner surface of the washover pipe;

a central support shoulder mounted to the central shaft positioned to limit a downhole motion of the spring-loaded fingers; and a screen uphole of the plurality of spring-loaded fingers to allow fluid passage and to prevent particles greater than a specified size from passing through the screen.

12. The downhole-type milling tool of claim 11, further comprising a lead tapered mill positioned at a downhole end of the central shaft, the lead tapered mill defining a second central flow path in line with the first interior flow path.

13. The downhole-type milling tool of claim 11, wherein the milling blades are arranged in a plurality of layers longitudinally around the shaft.

14. The downhole-type milling tool of claim 13, wherein each layer comprises three milling blades.

15. The downhole-type milling tool of claim 13, wherein the layers comprise a first layer and a second layer positioned uphole of the first layer.

16. The downhole-type milling tool of claim 13, wherein the layers comprise eight layers.

17. The downhole-type milling tool of claim 13, wherein the milling blades are between 40-50% of the area between the washover pipe and the central shaft at a transverse cross-section taken at one of the layers.

18. The downhole-type milling tool of claim 11, wherein each of the plurality of milling blades comprises:

a steel body; and a tungsten-carbide hardened face positioned on a downhole side of the steel body.

19. The downhole-type milling tool of claim 11, wherein the junk basket is a first junk basket, the tool further comprising a second junk basket uphole of the first junk basket.

* * * * *